US008794722B2

(12) United States Patent
Nuss et al.

(10) Patent No.: US 8,794,722 B2
(45) Date of Patent: Aug. 5, 2014

(54) DRAWER ASSEMBLY FOR AN APPLIANCE

(71) Applicant: General Electric Company, Schenectady, NY (US)

(72) Inventors: Bart Andrew Nuss, Fisherville, KY (US); Alan Joseph Mitchell, Louisville, KY (US)

(73) Assignee: General Electric Company, Schenectady, NY (US)

( * ) Notice: Subject to any disclaimer, the term of this patent is extended or adjusted under 35 U.S.C. 154(b) by 15 days.

(21) Appl. No.: 13/736,286

(22) Filed: Jan. 8, 2013

(65) Prior Publication Data

US 2014/0191646 A1 Jul. 10, 2014

(51) Int. Cl.
*A47B 88/00* (2006.01)
*F25D 25/02* (2006.01)

(52) U.S. Cl.
CPC ..... *F25D 25/025* (2013.01)
USPC ..... 312/334.2; 312/402

(58) Field of Classification Search
USPC ..... 312/402, 301, 334.2–334.3, 331, 332
See application file for complete search history.

(56) References Cited

U.S. PATENT DOCUMENTS 316,294 A * 4/1885 Roberts ..... 312/331
363,242 A * 5/1887 Johnson ..... 312/331
427,331 A * 5/1890 Knaus ..... 312/331
591,134 A * 10/1897 Howard ..... 312/331
629,698 A * 7/1899 Miller ..... 312/331
632,607 A * 9/1899 Wernicke ..... 312/323
657,809 A * 9/1900 Beebe ..... 312/331
688,074 A * 12/1901 Dumke ..... 312/331
735,277 A * 8/1903 Lehmann ..... 312/228
921,212 A * 5/1909 Fassett ..... 312/334.3
928,566 A * 7/1909 Weis et al. ..... 312/110
951,705 A * 3/1910 Schultz ..... 312/331
1,201,638 A * 10/1916 Schaefer ..... 312/331
3,323,853 A * 6/1967 Stark ..... 312/331
3,544,187 A * 12/1970 Hils ..... 312/331
4,324,439 A * 4/1982 Hagen et al. ..... 384/18
4,917,446 A * 4/1990 Mariani ..... 312/325
5,244,269 A * 9/1993 Harriehausen et al. ..... 312/247
5,458,412 A * 10/1995 Lee et al. ..... 312/309
6,086,170 A * 7/2000 Chen ..... 312/9.11
2006/0042305 A1* 3/2006 Oh et al. ..... 62/407
2006/0043848 A1* 3/2006 Jeong et al. ..... 312/310
2008/0238278 A1* 10/2008 Jeong et al. ..... 312/404
2009/0045713 A1* 2/2009 Kunkle et al. ..... 312/402
2009/0261698 A1* 10/2009 Cabal Velarde et al. ... 312/334.8
2010/0283365 A1* 11/2010 Chen ..... 312/334.4
2011/0210655 A1* 9/2011 Brown et al. ..... 312/334.8
2011/0285266 A1* 11/2011 Rotter et al. ..... 312/402
2012/0038255 A1* 2/2012 Netzer et al. ..... 312/319.1
2012/0080987 A1* 4/2012 Takamori ..... 312/327
2012/0091872 A1* 4/2012 Matthes et al. ..... 312/334.8

FOREIGN PATENT DOCUMENTS

KR 20080043150 5/2008

* cited by examiner

*Primary Examiner* — Darnell Jayne
*Assistant Examiner* — Ryan A Doyle
(74) *Attorney, Agent, or Firm* — Dority & Manning, PA

(57) ABSTRACT

A drawer assembly for an appliance is provided. The drawer assembly includes a container for receipt of items for storage and a linkage assembly positioned below the container. The container is supported by the linkage assembly such that the container is moveable along a transverse direction on the linkage assembly.

16 Claims, 8 Drawing Sheets

DRAWER ASSEMBLY FOR AN APPLIANCE

FIELD OF THE INVENTION

The present subject matter relates generally to drawer assemblies for appliances, such as refrigerator appliances.

BACKGROUND OF THE INVENTION

Bottom mount refrigerator appliances generally include an upper fresh food chamber and a bottom freezer chamber positioned below the upper fresh food chamber. A freezer drawer can be mounted within the freezer chamber for storing frozen food items therein. The freezer drawer is generally mounted such that the freezer drawer slides out of and into the freezer chamber when the freezer chamber's door is opened and closed, respectively.

Certain refrigerator appliances mount the freezer drawer within the refrigerator's freezer chamber using drawer slides. Such drawer slides are often expensive and can increase the overall cost of the refrigerator appliance. Also, such drawer slides can be mounted on opposite sides of the freezer drawer. In such a configuration, the drawer slides can consume valuable storage space within the freezer drawer and can also be visible to a user of the refrigerator appliance. However, drawer slides can have an unattractive aesthetic appearance. Thus, an appliance customer viewing the refrigerator appliance and seeing such drawer slides can have a negative impression of the refrigerator appliance due to the drawer slides.

Accordingly, a mechanism for mounting a drawer within a chamber of an appliance would be useful. In particular, a simple and/or inexpensive mechanism for mounting a drawer within a chamber of an appliance would be useful. In addition, a mechanism for mounting a drawer within a chamber of an appliance that conserves storage space would be useful. Further, a mechanism for mounting a drawer within a chamber of an appliance such that the mechanism is positioned out of sight to a user would be useful.

BRIEF DESCRIPTION OF THE INVENTION

The present subject matter provides a drawer assembly for an appliance. The drawer assembly includes a container for receipt of items for storage and a linkage assembly positioned below a bottom wall of the container. The container is supported by the linkage assembly such that the container is moveable along a transverse direction on the linkage assembly. Additional aspects and advantages of the invention will be set forth in part in the following description, or may be apparent from the description, or may be learned through practice of the invention.

In a first exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a housing that defines a chilled chamber. A drawer assembly is positioned within the chilled chamber of the housing. The drawer assembly includes a container that defines a storage volume for receipt of food items for storage. The container also has a bottom wall. A linkage assembly is positioned below the bottom wall of the container along the vertical direction. The container is supported by the linkage assembly such that the container is moveable along the transverse direction on the linkage assembly into and out of the chilled chamber of the housing. The linkage assembly includes a pair of fixed link arms spaced apart from one another along the lateral direction. Each fixed link arm of the pair of fixed link arms extends between a first end portion and a second end portion. The first end portions of the pair of fixed link arms are rotatably mounted to the housing. The linkage assembly also includes a pair of mobile link arms that are spaced apart from one another along the lateral direction. Each mobile link arm of the pair of mobile link arms extends between a first end portion and a second end portion. Each first end portion of the pair of mobile link arms is rotatably mounted to a respective second end portion of the pair of fixed link arms. A connecting link extends between and couples the second end portions of the pair of mobile link arms together.

In a second exemplary embodiment, a drawer assembly for an appliance is provided. The drawer assembly defines a vertical direction, a lateral direction, and a transverse direction. The vertical, lateral, and transverse directions are mutually perpendicular. The drawer assembly includes a container that defines a storage volume for receipt of items for storage. The container has a bottom wall. A linkage assembly is positioned below the bottom wall of the container along the vertical direction. The container is supported by the linkage assembly such that the container is moveable along the transverse direction on the linkage assembly. The linkage assembly includes a base and a pair of fixed link arms spaced apart from one another along the lateral direction. Each fixed link arm of the pair of fixed link arms extends between a first end portion and a second end portion. The first end portions of the pair of fixed link arms are rotatably mounted to the base. The linkage assembly also includes a pair of mobile link arms that are spaced apart from one another along the lateral direction. Each mobile link arm of the pair of mobile link arms extends between a first end portion and a second end portion. Each first end portion of the pair of mobile link arms is rotatably mounted to a respective second end portion of the pair of fixed link arms. A connecting link extends between and couples the second end portions of the pair of mobile link arms together.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

In FIG. 3, the drawer assembly is shown in a closed position.

In FIG. 4, the drawer assembly is shown in an open position.

In FIG. 5, the container of the drawer assembly is removed.

In FIG. 6, the container of the drawer assembly is removed.

DETAILED DESCRIPTION

Figure 1:
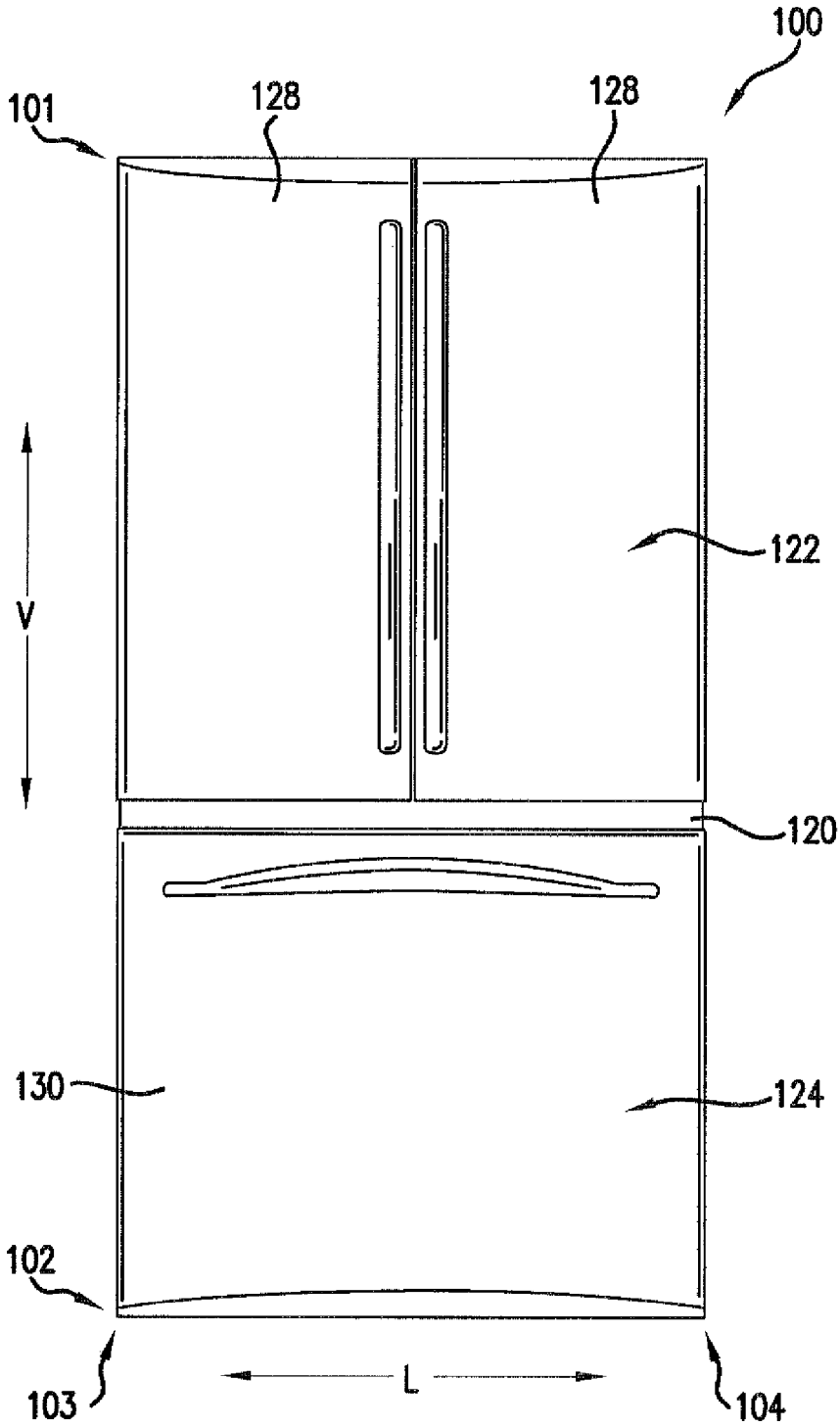
FIG. 1 provides a front, elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
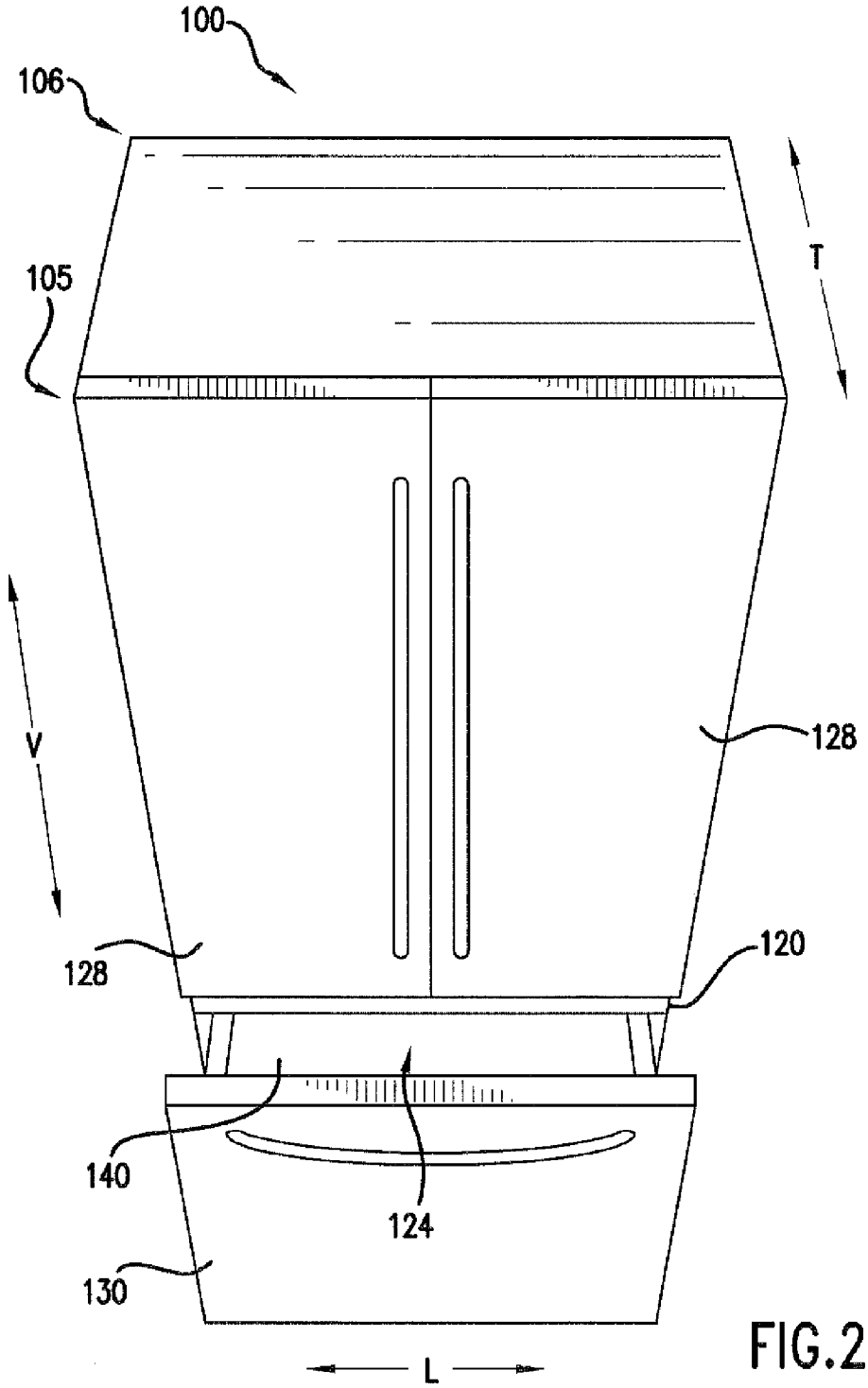
FIG. 2 provides a perspective view of the refrigerator appliance of FIG. 1 with a freezer drawer of the refrigerator appliance shown in an open position to reveal a freezer chamber of the refrigerator appliance.

FIG. 1 provides a front, elevation view of a refrigerator appliance 100 according to an exemplary embodiment of the present subject matter. In FIG. 1, refrigerator appliance 100 is shown with a freezer drawer 140 (FIG. 2) of refrigerator appliance 100 shown in a closed position. FIG. 2 provides a perspective view of refrigerator appliance 100 with freezer drawer 140 of refrigerator appliance 100 shown in an open position to reveal a freezer chamber 124 of refrigerator appliance 100.

Refrigerator appliance 100 includes a cabinet or housing 120 that extends between a top portion 101 and a bottom portion 102 along a vertical direction V. In addition, housing 120 extends between a first side portion 103 and a second side portion 104 along a lateral direction L and also extends between a front portion 105 and a back portion 106 along a transverse direction T. The vertical direction V, lateral direction L, and transverse direction T are mutually perpendicular and form an orthogonal direction system.

Housing 120 defines chilled chambers for receipt of food items for storage. In particular, housing 120 defines a fresh food chamber 122 positioned at or adjacent top 101 of housing 120 and also defines freezer chamber 124 arranged at or adjacent bottom 102 of housing 120. Refrigerator doors 128 are rotatably hinged to an edge of housing 120 for selectively accessing fresh food chamber 122. In addition, freezer door 130 is arranged below refrigerator doors 128 for selectively accessing freezer chamber 124. Freezer door 130 is coupled to freezer drawer 140 (FIG. 2) slidably mounted within freezer chamber 124.

Refrigerator appliance 100 is generally referred to as a bottom mount refrigerator. It is recognized, however, that the present subject matter can be used in other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Figure 3:
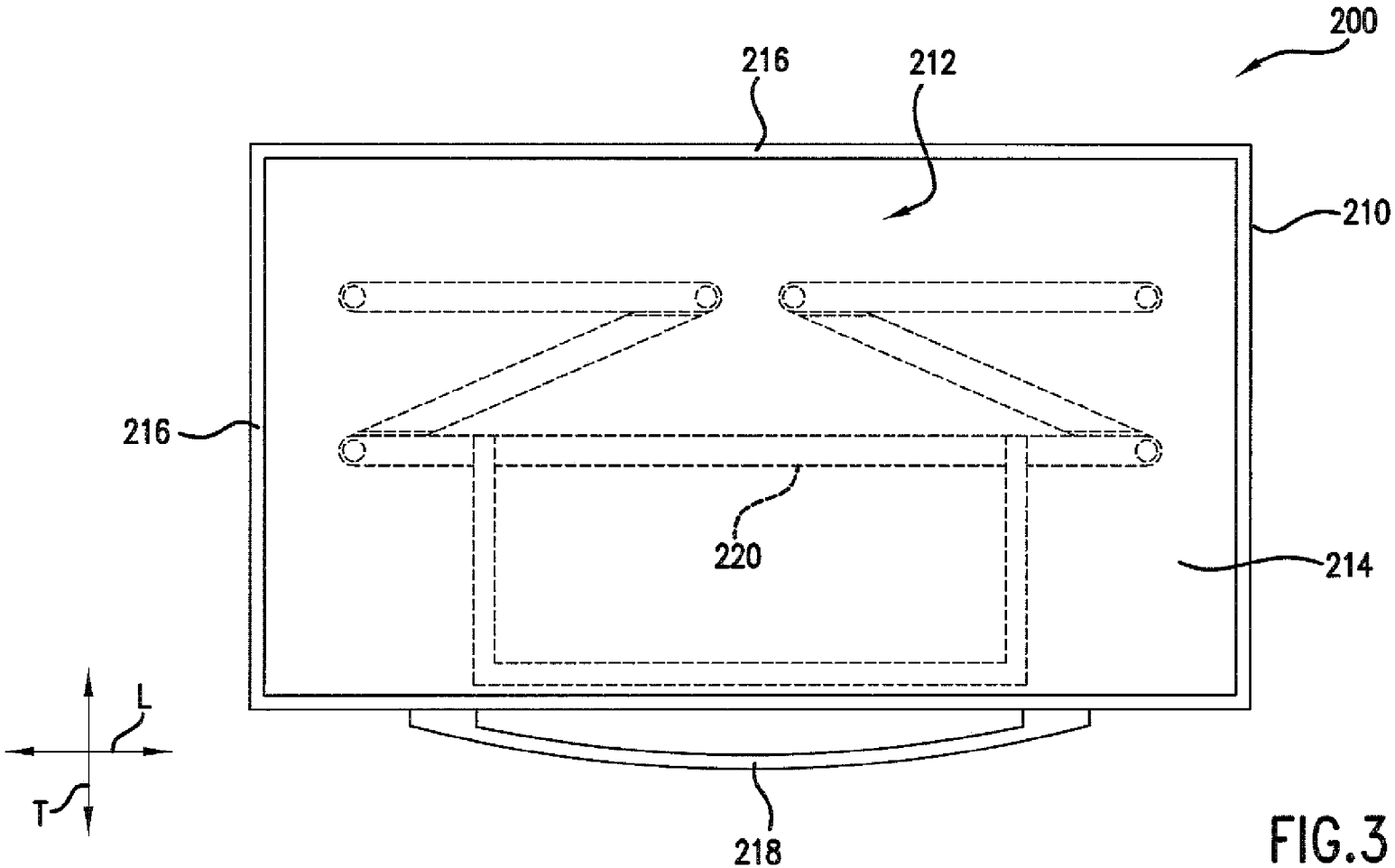
FIG. 3 provides a top, plan view of a drawer assembly according to an exemplary embodiment of the present subject matter. The drawer assembly includes a container and a linkage assembly mounted below the container.
Figure 4:
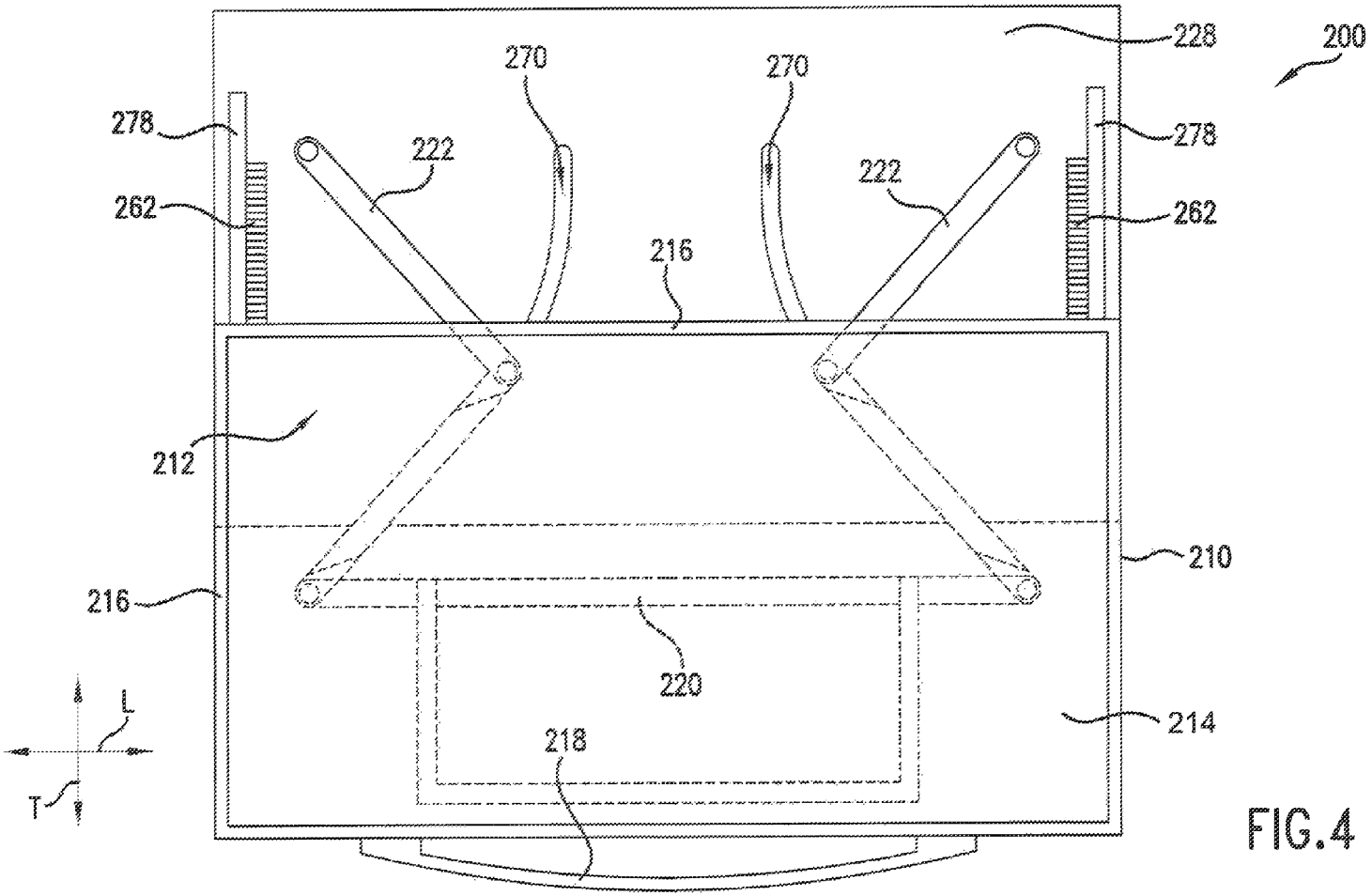
FIG. 4 provides a top, plan view of the drawer assembly of FIG. 3.

FIG. 3 provides a top, plan view of a drawer assembly 200 according to an exemplary embodiment of the present subject matter. In FIG. 3, drawer assembly 200 is shown in a closed position. FIG. 4 provides a top, plan view of drawer assembly 200 with drawer assembly 200 shown in an open position.

Drawer assembly 200 may be used in any suitable appliance, such as a refrigerator appliance, a range appliance, a washing machine appliance, or a dryer appliance. For example, drawer assembly 200 may be used in refrigerator appliance 100 (FIG. 1) as freezer drawer 140 (FIG. 2). Drawer assembly 200 defines vertical direction V (FIG. 7), lateral direction L, and transverse direction T.

Figure 7:
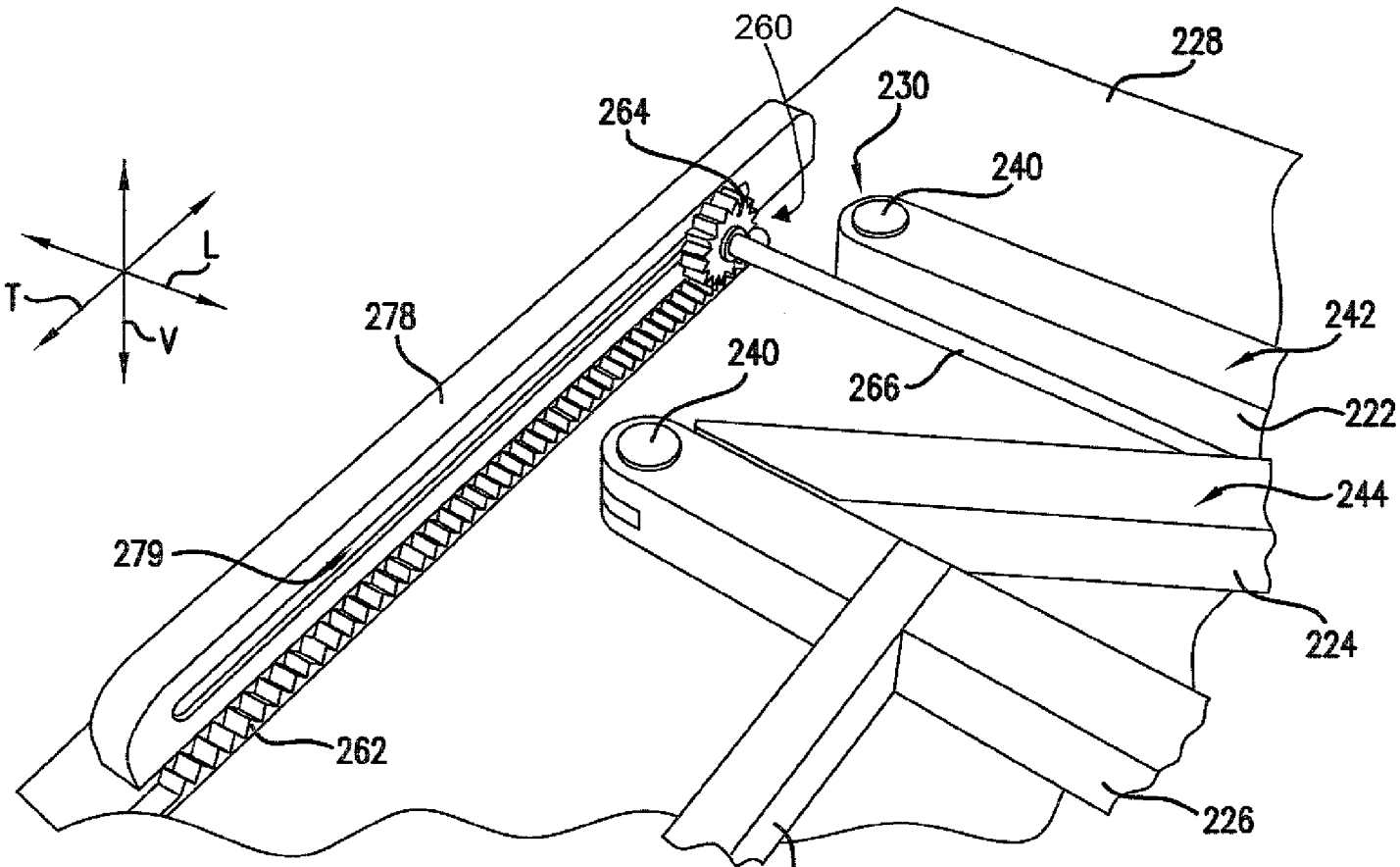
FIG. 7 provides a partial perspective view of the drawer assembly of FIG. 5 and an anti-racking mechanism of the drawer assembly.

Drawer assembly 200 includes a container 210 that defines a storage volume 212. In particular, container 210 has a bottom wall 214 and sidewalls 216 that define storage volume 212. Sidewalls 216 are mounted to bottom wall 214 and extend along the vertical direction V (FIG. 7). Storage volume 212 is configured for receipt of items for storage. For example, food items, pots, pans, or any other suitable object may be positioned and stored within storage volume 212 of container 210.

A linkage assembly 220 is positioned below container 210, e.g., along the vertical direction V. In particular, linkage assembly 220 is positioned below bottom wall 214 of container 210 along the vertical direction V. Container 210 is supported by or sits on linkage assembly 210. Linkage assembly 220 supports container 210 such that container 210 is moveable along the transverse direction T on linkage assembly 220. In particular, linkage assembly 220 guides movement of container 210 along the transverse direction T between the closed position shown in FIG. 3 and the open position shown in FIG. 4.

As an example, from the closed position shown in FIG. 3, a user can pull on a handle 218 mounted to container 210, e.g., in the transverse direction T. When the user pulls on handle 218, container 210 shifts along the transverse direction T towards the open position shown in FIG. 4. While container 210 is shifting, linkage assembly 220 guides container 210 and directs container 210 towards the open position shown in FIG. 4. Thus, the user can pull on handle 218 and linkage assembly 220 will guide container 210 until container 210 reaches the open position shown in FIG. 4. In the open position, the user can add objects into storages volume 212 of container 210 or remove container 210 from linkage assembly 220. Once the user is finished, the user can again use handle 218 or simply push on container 210 in order to slide container 210 along the transverse direction T back towards the closed position shown in FIG. 3. During such movement, linkage assembly 220 can guide container 210 into the closed position. Linkage assembly 220 is discussed in greater detail below.

Figure 5:
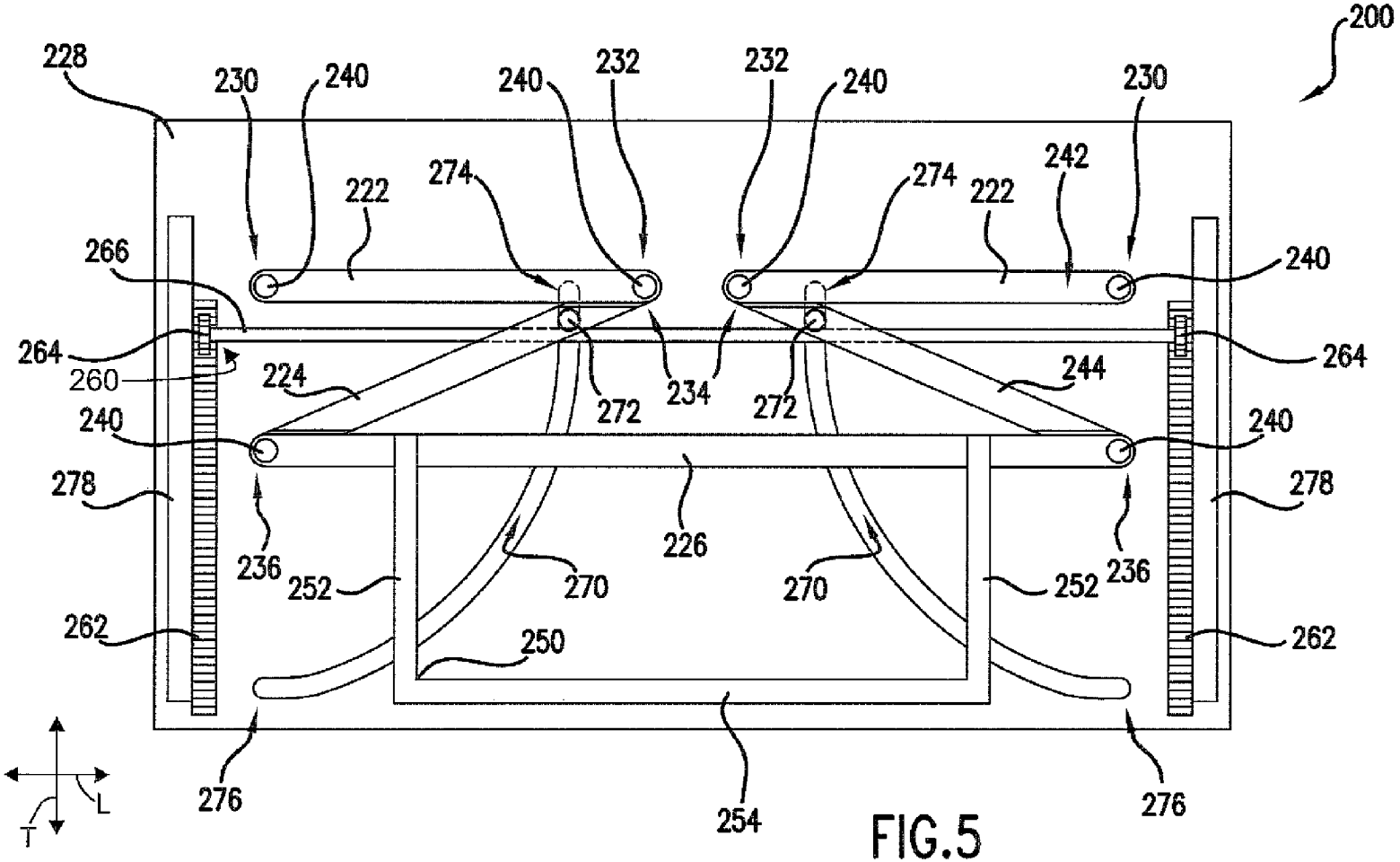
FIG. 5 provides a top, plan view of the drawer assembly of FIG. 3.
Figure 6:
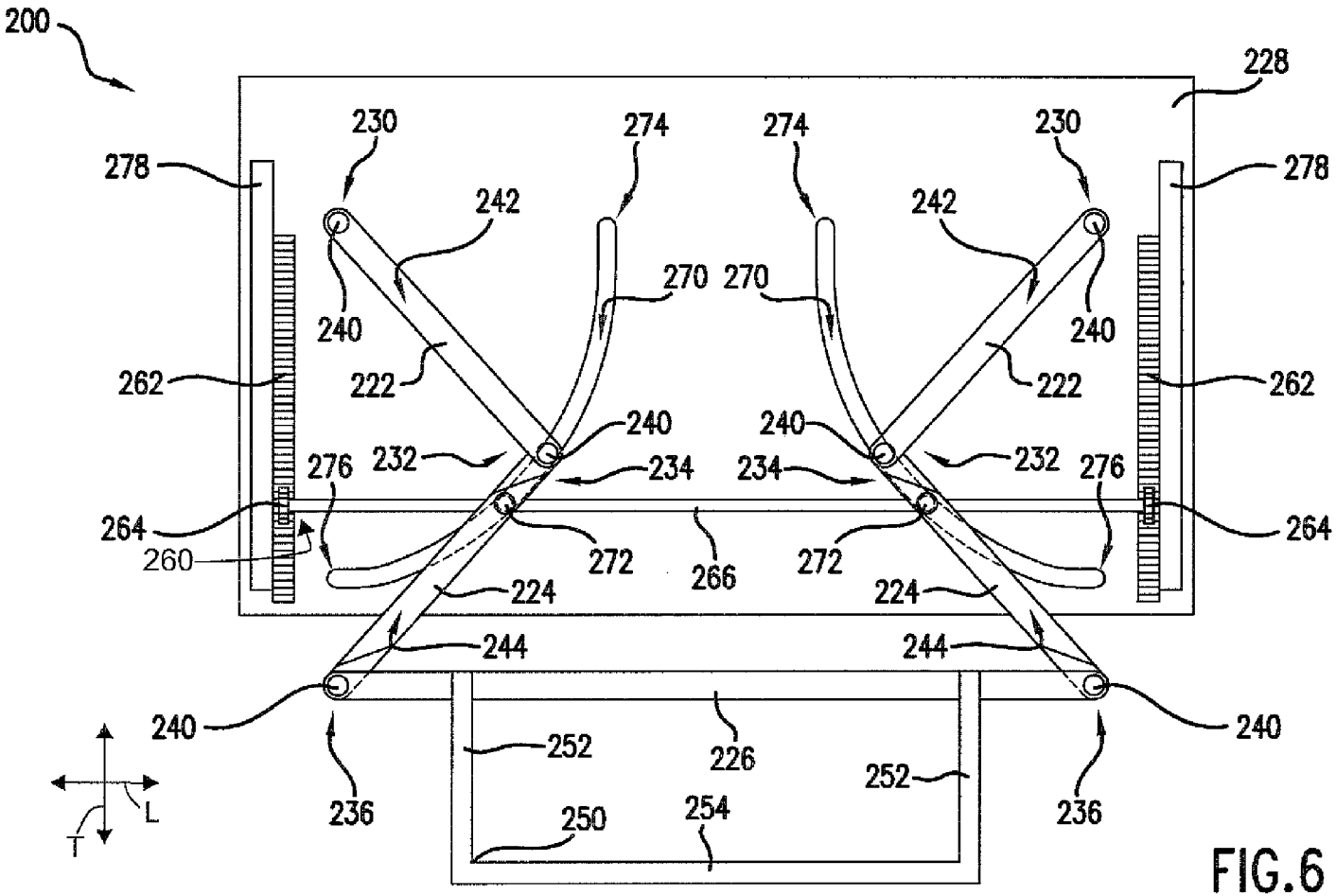
FIG. 6 provides a top, plan view of the drawer assembly of FIG. 4.

FIG. 5 provides a top, plan view of drawer assembly 200 in the closed position. FIG. 6 provides a top, plan view of drawer assembly 200 in the open position. In FIGS. 5 and 6, container 210 of drawer assembly 200 is removed to reveal linkage assembly 220 and other features of drawer assembly 200.

Linkage assembly 220 includes a base 228. As an example, base 228 may be integrally mounted to housing 120 of refrigerator appliance 100 such that base 228 forms a wall of freezer chamber 124 (FIG. 2). Alternatively, base 228 may be a separate component mounted within freezer chamber 124.

Linkage assembly 220 also includes a pair of fixed link arms 222 spaced apart from one another along the lateral direction L. Each fixed link arm of pair of fixed link arms 222 extends, e.g., longitudinally, between a first end portion 230 and a second end portion 232. First end portions 230 of pair of fixed link arms 222 are rotatably mounted to base 228, e.g., housing 120 (FIG. 2). As an example, first end portions 230 of pair of fixed link arms 222 may be bolted or screwed to base 228 such that pair of fixed link arms 222 can rotate relative to base 228.

Linkage assembly 220 further includes a pair of mobile link arms 224 spaced apart from one another along the lateral direction L. Each mobile link arm of pair of mobile link arms 224 extends, e.g., longitudinally, between a first end portion 234 and a second end portion 236. Each first end portion 234 of pair of mobile link arms 224 is rotatably mounted to a respective second end portion 232 of pair of fixed link arms 222. As an example, first end portions 234 of pair of mobile link arms 224 may be bolted or screwed to the respective second end portion 232 of pair of fixed link arms 222 such that pair of mobile link arms 222 can rotate relative to pair of fixed link arms 222.

Linkage assembly 220 also includes a connecting link 226. Connecting link 226 extends between and couples second end portions 236 of pair of mobile link arms 224 together. In the exemplary embodiment shown in FIGS. 5 and 6, connecting link 226 includes a linear piece of material similar to pair of fixed link arms 222 and pair of mobile link arms 224. However, in alternative exemplary embodiments, connecting link 226 may be integrally mounted to or molded from container 210.

As an example, during motion of linkage assembly 220 between the closed position shown in FIG. 5 and the open position shown in FIG. 6, pair of fixed link arms 222 can rotate at first end portions 230 of pair of fixed link arms 222 and pair of mobile link arms 224 can rotate at first end portion 234 of pair of mobile link arms 224. In particular, as shown in FIGS. 5 and 6, pair of fixed link arms 222 and pair of mobile link arms 224 can cooperate to form a pair of two-bar linkage arms that extend and retract in order to shift linkage assembly 220 between the open and closed positions.

Drawer assembly 200 also includes a frame 250 for supporting container 210. Frame 250 is mounted to connecting link 226. In particular, frame 250 includes a pair of transverse members 252 mounted to connecting link 226. Each transverse member of pair of transverse members 252 extends longitudinally along the transverse direction T. Frame 250 also includes a lateral member 254 that extends longitudinally along the lateral direction L between pair of transverse members 252. Thus, lateral member 254 connects pair of transverse members 252.

Container 210 can sit or rest on frame 250. Further, container 210 can be mounted to frame 250. As an example, screws or bolts can secure container 210 to frame 250 such that container 210 is mounted to frame 250 within drawer assembly 200.

Linkage assembly 220 also includes a plurality of anti-friction mechanisms 240. Anti-friction mechanisms 240 are disposed on a top surface 242 of said pair of fixed link arms 222 and a top surface 244 of said pair of mobile link arms 224. Anti-friction mechanisms 240 can assist with sliding of container 210 on linkage assembly 220. In particular, anti-friction mechanisms 240 are disposed between top surfaces 242 and 244 and bottom wall 214 of container 210 when container 210 is mounted on linkage assembly 220, e.g., in order to assist container 210 with moving along the transverse direction T between the open and closed positions. Anti-friction mechanisms 240 can be any suitable device for reducing friction between container 210 and linkage assembly 220. For example, anti-friction mechanisms 240 can include bearings, rollers, plastic pads, felt pads, or any suitable combination thereof.

Base 228 defines a pair of channels 270 that extend into base 228 along the vertical direction V. In the exemplary embodiments shown in FIGS. 6 and 7, each channel of channels 270 extends arcuately along the lateral and transverse directions L and T between a first end portion 274 and a second end portion 276. Channels 270 are configured for guiding linkage assembly 220, e.g., during motion of linkage assembly 220 between the open and closed positions. In particular, each mobile link arm of pair of mobile link arms 224 has a boss 272 mounted thereto. Each boss 272 is received within a respective one of channels 270. Bosses 272 can slide within channels 270 in order to guide motion of mobile link arms 224 and linkage assembly 220. In particular, bosses 272 sliding within channels 270 can assist with hindering racking of linkage assembly 220. Drawer assembly 200 also includes additional features for hindering racking of linkage assembly 220 as discussed in greater detail below.

Figure 8:
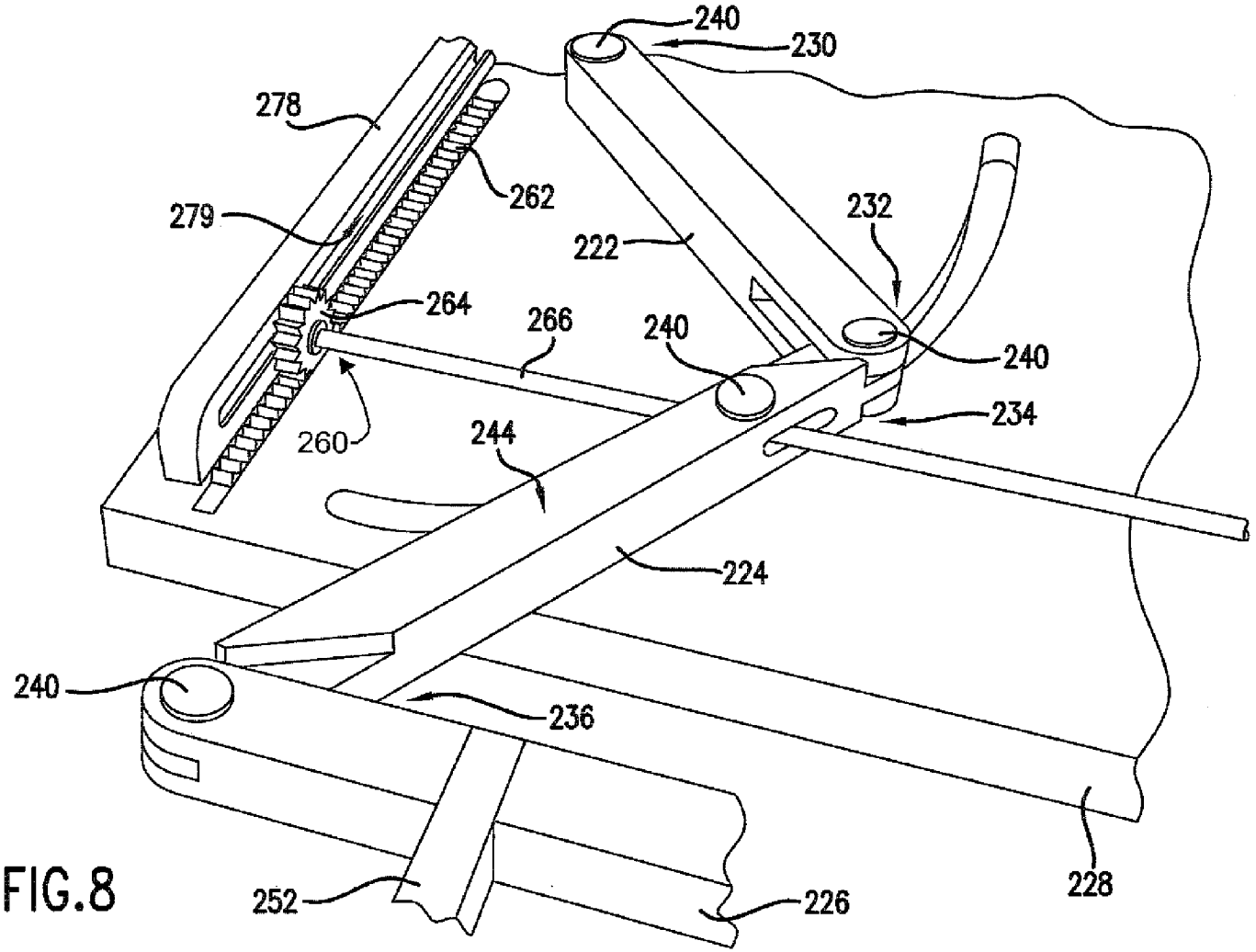
FIG. 8 provides a partial perspective view of the drawer assembly of FIG. 6 and the anti-racking mechanism of the drawer assembly.

FIGS. 7 and 8 provide partial perspective views of drawer assembly 200 and an anti-racking mechanism 260 of drawer assembly 200. In FIG. 7, drawer assembly 200 is in a closed position. In FIG. 8, drawer assembly 200 is in an open position.

Anti-racking mechanism 260 is mounted to base 228 and is configured for assisting pair of fixed link arms 222 and/or pair of mobile link arms 224 with rotating at a common angular velocity, e.g., in order to hinder linkage assembly 220 from racking. As may be seen in FIGS. 5 and 6, anti-racking mechanism 260 includes a pair of tracks 262 mounted to base 228 at opposing sides of base 228 such that tracks 262 are spaced apart from one another along the lateral direction L. Tracks extend longitudinally along the transverse direction T.

Anti-racking mechanism 260 also includes a pair of gears 264. Each gear of pair of gears 264 engages a respective one of pair of tracks 262. A shaft 266 extends between and couples pair of gears 264 together. Shaft 266 is rotatably mounted to pair of mobile link arms 224. In alternative exemplary embodiments, shaft 266 may be rotatably mounted to pair of fixed link arms 222 or connecting link 226.

Anti-racking mechanism 260 further includes guides 278 mounted at each one of pair of tracks 262. As may be seen in FIGS. 8 and 9, each guide of guides 278 defines a slot 279 that receives shaft 266. Guides 278 can assist with engaging gears 264 and tracks 262, e.g., by hindering gears 264 from lifting off tracks 262 along the vertical direction V.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, the refrigerator appliance defining a vertical direction, a lateral direction, and a transverse direction, the vertical, lateral, and transverse directions being mutually perpendicular, the refrigerator appliance, comprising:

a housing defining a chilled chamber;

a drawer assembly positioned within the chilled chamber of said housing, said drawer assembly comprising a container defining a storage volume for receipt of food items for storage, said container having a bottom wall;

a linkage assembly positioned below the bottom wall of said container along the vertical direction, said container supported by said linkage assembly such that said container is moveable along the transverse direction on said linkage assembly into and out of the chilled chamber of said housing, said linkage assembly comprising a pair of fixed link arms spaced apart from one another along the lateral direction, each fixed link arm of said pair of fixed link arms extending between a first end portion and a second end portion, the first end portions of said pair of fixed link arms rotatably mounted to said housing;

a pair of mobile link arms spaced apart from one another along the lateral direction, each mobile link arm of said pair of mobile link arms extending between a first end portion and a second end portion, each first end portion of said pair of mobile link arms rotatably mounted to a respective second end portion of said pair of fixed link arms; and a connecting link extending between and coupling the second end portions of said pair of mobile link arms together an anti-racking mechanism mounted to said housing below the bottom wall of said container and configured for assisting said pair of fixed link arms with rotating at a common angular velocity; wherein said anti-racking mechanism comprises:

a pair of tracks mounted to said housing at opposing sides of said housing such that said pair of tracks are spaced apart from one another along the lateral direction, said pair of tracks extending longitudinally along the transverse direction;

a pair of gears, each gear of said pair of gears engaging a respective one of said pair of tracks; and a shaft extending between and coupling said pair of gears together.

2. The refrigerator appliance of claim 1, further comprising a plurality of anti-friction mechanisms disposed on a top surface of at least one of said pair of fixed link arms and said pair of mobile link arms.

3. The refrigerator appliance of claim 2, wherein said plurality of anti-friction mechanisms is disposed between the bottom wall of said container and the top surface of at least one of said pair of fixed link arms and said pair of mobile link arms in order assist said container with moving along the transverse direction.

4. The refrigerator appliance of claim 1, further comprising a frame for supporting said container, said frame comprising:

a pair of transverse members mounted to said connecting link and extending longitudinally along the transverse direction; and a lateral member extending longitudinally along the lateral direction, said lateral member also extending between and connecting said pair of transverse members.

5. The refrigerator appliance of claim 4, wherein said container is mounted to said frame.

6. The refrigerator appliance of claim 1, wherein said shaft is rotatably mounted to said pair of fixed link arms or said pair of mobile link arms.

7. The refrigerator appliance of claim 1, wherein said housing defines a pair of channels that extend into said housing along the vertical direction, each mobile link arm of said pair of mobile link arms having a boss mounted thereto, each boss received within a respective one of said pair of channels.

8. The refrigerator appliance of claim 7, wherein each channel of said pair of channels extends arcuately along the lateral and transverse directions between a first end portion and a second end portion.

9. A drawer assembly for an appliance, the drawer assembly defining a vertical direction, a lateral direction, and a transverse direction, the vertical, lateral, and transverse directions being mutually perpendicular, the drawer assembly, comprising:

a container defining a storage volume for receipt of items for storage, said container having a bottom wall;

a linkage assembly positioned below the bottom wall of said container along the vertical direction, said container supported by said linkage assembly such that said container is moveable along the transverse direction on said linkage assembly, said linkage assembly comprising a base;

a pair of fixed link arms spaced apart from one another along the lateral direction, each fixed link arm of said pair of fixed link arms extending between a first end portion and a second end portion, the first end portions of said pair of fixed link arms rotatably mounted to said base;

a pair of mobile link arms spaced apart from one another along the lateral direction, each mobile link arm of said pair of mobile link arms extending between a first end portion and a second end portion, each first end portion of said pair of mobile link arms rotatably mounted to a respective second end portion of said pair of fixed link arms; and a connecting link extending between and coupling the second end portions of said pair of mobile link arms together an anti-racking mechanism mounted to said base below the bottom wall of said container and configured for assisting said pair of fixed link arms with rotating at a common angular velocity; wherein said anti-racking mechanism comprises:

a pair of tracks mounted to said base at opposing sides of said base such that said pair of tracks are spaced apart from one another along the lateral direction, said pair of tracks extending longitudinally along the transverse direction;

a pair of gears, each gear of said pair of gears engaging a respective one of said pair of tracks; and a shaft extending between and coupling said pair of gears together.

10. The drawer assembly of claim 9, further comprising a plurality of anti-friction mechanisms disposed on a top surface of at least one of said pair of fixed link arms and said pair of mobile link arms.

11. The drawer assembly of claim 10, wherein said plurality of anti-friction mechanisms is disposed between the bottom wall of said container and the top surface of at least one of said pair of fixed link arms and said pair of mobile link arms in order assist said container with moving along the transverse direction.

12. The drawer assembly of claim 9, further comprising a frame for supporting said container, said frame comprising a pair of transverse members mounted to said connecting link and extending longitudinally along the transverse direction; and a lateral member extending longitudinally along the lateral direction, said lateral member also extending between and connecting said pair of transverse members.

13. The drawer assembly of claim 12, wherein said container is mounted to said frame.

14. The drawer assembly of claim 9, wherein said shaft is rotatably mounted to said pair of fixed link arms or said pair of mobile link arms.

15. The drawer assembly of claim 9, wherein said base defines a pair of channels that extend into said base along the vertical direction, each mobile link arm of said pair of mobile link arms having a boss mounted thereto, each boss received within a respective one of said pair of channels.

16. The drawer assembly of claim 15, wherein each channel of said pair of channels extends arcuately along the lateral and transverse directions between a first end portion and a second end portion.

* * * * *